US006752430B2

(12) United States Patent
Holt et al.

(10) Patent No.: US 6,752,430 B2
(45) Date of Patent: Jun. 22, 2004

(54) TIME DEPENDENT COLOR-CHANGING SECURITY INDICATOR

(75) Inventors: Robert Holt, Cornwall-On-Hudson, NY (US); David J. Haas, Suffern, NY (US); Brian DiBianco, Pomona, NY (US)

(73) Assignee: Brady Worldwide Corp., Milwaukee, WI (US)

( * ) Notice: Subject to any disclaimer, the term of this patent is extended or adjusted under 35 U.S.C. 154(b) by 0 days.

(21) Appl. No.: 09/934,243

(22) Filed: Aug. 21, 2001

(65) Prior Publication Data

US 2002/0105183 A1 Aug. 8, 2002

Related U.S. Application Data

(60) Provisional application No. 60/266,601, filed on Aug. 21, 2000.

(51) Int. Cl.[7] ..... B42D 15/00

(52) U.S. Cl. ..... 283/72; 283/114; 283/67; 283/70; 283/75

(58) Field of Search ..... 283/67, 70, 72, 283/74, 114; 368/327

(56) References Cited

U.S. PATENT DOCUMENTS 5,261,954 A * 11/1993 Collings ..... 283/114
5,364,132 A 11/1994 Haas et al.
5,446,705 A 8/1995 Haas et al.
5,602,804 A 2/1997 Haas
5,715,215 A 2/1998 Haas et al.
5,719,828 A 2/1998 Haas et al.
5,785,354 A 7/1998 Haas
5,822,280 A 10/1998 Haas
5,873,606 A 2/1999 Haas et al.
5,930,206 A 7/1999 Haas et al.
5,957,458 A 9/1999 Haas et al.
5,974,003 A 10/1999 Pedicano et al.

* cited by examiner

*Primary Examiner*—Willmon Fridie, Jr.
(74) *Attorney, Agent, or Firm*—Michael Zall

(57) ABSTRACT

This invention converts commercially available plastic ID cards, usually made of PVC, and/or electronically printed documents, e.g., laser printed documents, photo copier printed documents, dye-sublimation printed documents, ink jet printed documents, into time dependant, self-expiring badges or documents that display a visual indicia, e.g., change of color, appearance of a word, e.g., VOID after a specified or predetermined period of time.

Broadly, a pressure sensitive security sticker is applied to these commercially available plastic ID cards and/or electronically printed documents. The sticker changes color, typically from white to red, after a predetermined period of time. This change in color is caused by the toner/dye/color pigment contained in these documents. The sticker provides a time dependent indicator for these documents. These security stickers can also display words like 'VOID' after the expiration of the document or card so that security personnel will readily recognize that the ID credential or document is no longer valid.

9 Claims, 3 Drawing Sheets

TIME DEPENDENT COLOR-CHANGING SECURITY INDICATOR

RELATED APPLICATIONS

This application is related to Provisional Application Ser. No. 60/266,601 filed on Aug. 21, 2000 entitled A Time Dependant Self Expiring Security Sticker for PVC Photo Id Badges to Eliminate Reuse of Badges. The entire disclosure of this provisional application is incorporated herein by reference.

BACKGROUND OF THE INVENTION

1. Field of the Invention

An object of this invention is to convert commercially available plastic ID cards and/or electronically printed documents into time dependant, self-expiring badges or documents that display a visual indicia, e.g., change of color, appearance of a word, e.g., VOID after a specified or predetermined period of time.

2. Prior Art

Electronically printed security cards and security documents generally have a specified or predetermined period of time for valid use. Typically, this period of time is specified by printing an expiration date on the document. In order to make the expiration of any of these documents or cards more visible for security personnel, particularly from a distance, it has been found that a change of color after the expiration period works best because people sense a color change more readily and faster than reading printed dates and other printed matter.

Generally, plastic photo ID badges and other electronically printed security documents are issued to employees and other individuals in order to provide a uniform security system for access to facilities and authorization to be places at certain times. Prior to the development of the dye sublimation printer for PVC cards, all photo ID badges were constructed with, for example, Polaroid type photos laminated onto a polyester pouch or card. Since about 1995, this original "cut and paste" photo ID badge system has been replaced by electronic imaging systems that employ dye sublimation printers on blank PVC (polyvinyl chloride) credit card size cards.

In general, the vast majority of PVC ID cards are made secure by merely printing a specific design and color on the card itself. A blank, typically a white PVC card, is printed with a specific design along with the image of the individual. If a company wants to make their badges more secure, they attach an overlaminate onto this card so that the overlaminate contains some visual device such as optically variable printing or a hologram to confirm that the card was issued by them and is not a duplicate (counterfeit) printed on another printer.

It is a well know fact that security personnel and employees have a difficult time verifying that particular ID badges are authentic. Generally, people do not read the specific data on a card such as the date, and they do not compare the image of the person on the card with the person actually holding the card. People generally only review the overall impression and colors of the card in the few seconds (or less) that they have to review it. This problem exists with most Visitor and temporary ID badges. Because each badge looks identical to all other cards except for the date, people simply assume that the badge is valid if it has the general appearance of the normal visitor badge. Over the years, this has been demonstrated to provide a useless ID security control system because once a person is in possession of the visitor badge; they can, and do, frequently reuse it.

Beginning about 1980, applicant's assignee, Temtec, Inc. devised a new concept in visitor and temporary badge control. Examples of these products and the technology used by these products are represented by the Haas patents discussed herein. These products have become universally accepted as the means for controlling and improving visitor security and temporary badges. These products are generally self-expiring visitor badges, which simply change color, and show an "expired" indicia after the predetermined authorization time has lapsed. This means that "valid" visitor badges only exist for the time period they are valid and that after that time interval, they self-expire by changing color. Thus, security personnel and employees can quickly confirm that a person possessing a visitor badge is authorized for entry into the facility. Thus, this "look-alike" phenomenon of temporary security badges that had plagued security managers for years has been eliminated by the development of the color-changing temporary ID badge.

This same "look-alike" phenomena exists with the new, commercially available PVC photo ID cards and has developed into a security weakness. Since the PVC cards for visitors and temporary employees all look the same, one can easily fail to notice that they have expired or are counterfeit. This invention converts commercially available plastic (PVC) ID cards and/or electronically printed documents into time dependant, self-expiring badges or documents that display a visual indicia, e.g., change of color, appearance of a word, e.g., VOID after a specified or predetermined period of time. Such an invention provides an inexpensive means of enhancing security.

The following US Patents may be relevant to this invention:

RE U.S. Pat. No. 36,519 to Lum et al. describes a dye-donor element for resistive head thermal dye transfer comprising a support having thereon a dye layer comprising an image dye in a polymeric binder, and wherein the dye layer also contains a polymeric plasticizer.

U.S. Pat. No. 4,541,830 to Hotta et al describes a dye transfer sheet for heat-sensitive recording which comprises a substrate, and a thin layer of at least one sublimable dye formed on one side of the substrate. The dye layer comprises non-sublimable particles uniformly distributed throughout the layer to form irregularities on the layer surface.

U.S. Pat. No. 4,621,271 to Broenstein et al. describes a thermal printer apparatus which includes a print head having a plurality of groups of thermal pixels. The thermal pixels in each group are simultaneously addressed in parallel. Each group is addressed a plurality of times. The apparatus selectively energizes the thermal pixels of each group when they are addressed until each thermal pixel is at a temperature where it can supply energy to a carrier member which delivered an amount of dye to a receiver which corresponds to a desired dye density in an image pixel.

U.S. Pat. No. 4,916,112 to Henzel et al. describes a dye-donor element for thermal dye transfer comprising a support having on one side thereof a dye layer and on the other side a slipping layer comprising an organic lubricating material in a binder, the lubricating material comprising a nonhomogeneous layer of a particulate ester wax comprising an ester of a fatty acid and a monohydric alcohol, the ester wax having a particle size of from about 0.5 $\mu$m to about 20 $\mu$m.

U.S. Pat. No. 4,927,803 to Balry et al. describes a dye-receiving element for thermal dye transfer comprising a support having thereon a polymeric dye image-receiving layer containing a polycarbonate.

U.S. Pat. No. 5,023,228 to Henzel describes a dye-donor element for thermal dye transfer comprising a poly(ethylene terephthalate) support having thereon, in order, a subbing layer and a dye layer comprising a dye dispersed in a cellulosic binder, and wherein said subbing layer comprises a copolymer of vinyl alcohol and an alkyl ester of vinyl alcohol, such as vinyl acetate.

U.S. Pat. No. 5,332,713 and 5,387,573 to Oldfield et al. describes a dye-donor element for thermal dye transfer comprising a support having thereon at least one dye layer area comprising an image dye in a binder and another area comprising a transferable protection layer, the transferable protection layer area being approximately equal in size to the dye layer area.

U.S. Pat. No. 5,688,738 to Lu describes a security card comprising a backing, a cover film, and a security image, the security image being located between the backing and the cover film, the backing and the cover film being laminated together without an intermediate adhesive layer. The backing comprises an amorphous copolyester or polyvinyl chloride, and the cover film comprises the other of polyvinyl chloride or an amorphous copolyester.

U.S. Pat. No. 5,723,405 to Hastreiter. Jr. et al. describes a dye-receiver element comprising a support having thereon a dye-receiving layer containing a thermally-transferred dye image, the dye-receiving layer being laminated to a transparent protective sheet by means of a phenoxy resin adhesive.

U.S. Pat. No. 5,756,188 to Reiter et al describes an image-receiving laminate for an identification card stock. The laminate comprises an oriented polymeric film support having an image-receiving layer located on a first outermost surface thereof, the image-receiving layer having an embossed surface, and the second outermost surface of the oriented polymeric film support having a heat- or chemically-activated adhesive thereon.

U.S. Pat. No. 5,789,340 to Brust et al describes an identification card stock comprising a polymeric core substrate having on at least one side thereof the following layers in order: an oriented polymeric film, a cushion layer of an acrylic polymer, a subbing layer and an image-receiving layer.

U.S. Pat. No. 5,792,725 to Simpson et al describes an identification card comprising a card stock of plastic material having magnetic particles uniformly dispersed throughout>The card stock also has a polycarbonate image-receiving layer located on the outermost surface of at least one side of the card stock.

U.S. Pat. No. 5,843,617 to Patel et al describes an imaging method that comprises bleaching a tetraarylpolymethine dye with a dihydropyridine derivative.

U.S. Pat. No. 5,846,900 to Reiter et al. describes an identification card stock comprising a polymeric core substrate having an oriented polymeric film laminated on at least one side thereof. The card stock also has an image-receiving layer located on the outermost surface of at least one side of the card stock.

U.S. Pat. No. 5,956,067 to Isono et al. describes a thermal transfer printing device for printing photorealistic color images with dye-sublimation inks of different colors and two-gradation images, such as character and bar code patterns, with a monochrome thermal wax-transfer ink respectively in separated printing sections.

U.S. Pat. No. 6,022,429 to Hagstrom describes a lamination system that includes a supply and a take-up roll carrying a web therebetween that carries a laminate. The laminate is applied to a printed card as the card moves between two rollers.

U.S. Pat. No. 5,364,132 to Haas et al. describes a method of assembly and activation of a reusable self-expiring Security Identification Badge. The Badge includes a base substrate having a void indicia area, an ink substrate having an expired indicia area of a soluble ink and an adhesive surface, and an overlay substrate having an ink dissolver and a display surface. When the Security I.D. Badge is issued, the inked substrate is attached to the base substrate, the inked substrate covering the void indicia area. The overlay substrate is then placed over and attached to the inked substrate, the ink dissolver in contact with the soluble ink of the ink substrate. The ink dissolver of the overlay substrate contacts and coacts with the soluble ink of the inked substrate to dissolve the ink and allow the ink to migrate through to the overlay substrate to the display surface, where it can be visually perceived, in a preselected time interval.

U.S. Pat. No. 5,446,705 to Haas et al describes a time indicator that changes color or produces an image or information after a specific time interval. The time indicator includes a base substrate with colored dye deposited on a first surface; and a substrate having an adhesive on a first surface thereof, the adhesive positioned at discrete locations on the first surface of the substrate. The substrate and the base substrate are put into adhesive contact. The adhesive contacts and coacts the colored dye to dissolve the dye and permit the dye to migrate through the adhesive to cause a color change visible through the substrate. The discrete adhesive inhibits lateral migration of the dye to preserve the image or information of the dye in a clear and/or understandable condition.

U.S. Pat. No. 5,602,804 to Haas describes a time indicator device with a display layer with at least one defined display region therein. A migration layer is provided which overlies and is attached to the display layer. The migration layer has at least one migration region therein and in use each migration region is in contact with at least one display region. An activation layer is provided which has at least one defined activation region therein. The activation region includes a migrating agent capable of migrating laterally through the migration region. When the activation layer overlies the migration layer, each activation region overlies at least one migration region. The migration region connects each activation region with at least one display region which is laterally distal from the activation region. In use and in order to activate the device the activation layer and migration layer are adhesively attached to each other. When the activation layer is contacted with and overlies the migration layer, each activation region contacts at least one migration region. Upon contact the migrating agent is activated to migrate laterally from the activation region through the migrating region to at least one display region in a predetermined amount of time to cause an indication in the display region that the predetermined amount of time has elapsed. Preferably, the device has a plurality of defined display regions, defined activation regions and/or migration regions to provide a means for adjusting the predetermined time, adjusting for environmental conditions and to provide a plurality of elapsed times.

U.S. Pat. No. 5,715,215 and 5,873,606 to Haas et al describe an identification badge that comprises a base coated with an adhesive protected by release paper. This badge is assembled by removing the release paper, placing an identification card into contact with the adhesive, and then attaching a fastener through a slot in the base of the badge. Various fasteners may be used to attach this badge to wearer's apparel. The identification card can also be mounted so that the identification indicia is placed against a transparent, adhesive and viewed through a transparent base. A timing indicator can be incorporated into the badge so as to show the expiration of the badge after a selected period of time.

U.S. Pat. No. 5,719,828 to Hass et al. describes a patterned indicator which contains latent information. The patterned indicator includes a first substrate having first and second surfaces, the first surface having a uniform pattern printed of an ink thereon. A second transparent substrate having first and second surfaces is also provided. An adhesive activator is provided on the first surface of the second substrate. The indicator is activated by placement of the first surfaces of the first and second substrates into adhesive contact such that the ink and adhesive activator coact to cause the ink pattern to gradually bleed and blend together to cause a change visually perceptible through the transparent substrate in a selected time interval. A preferred embodiment of the invention is a parking permit, while other preferred embodiments include transit tickets, admission tickets, time passage indicators for other applications. Also within the scope of this invention are patterned indicators printed with inks having multiple sensitivities for indicating tampering with goods in packages sealed with such indicators.

U.S. Pat. No. 5,785,354 to Hass describes an identification band is provided which includes an elongated band having an outer surface, an inner surface and first and second ends. A first chemical composition, e.g., a soluble ink, is distributed on the outer surface of the band proximate the first end. A display region is disposed in the band proximate the second end. A second chemical composition, e.g., an adhesive ink activator is distributed on the inner surface of the band overlying the display region proximate the second end. When the band is wrapped around an object, e.g., a user's wrist, with the outer surface exposed, the outer surface of the first end and the inner surface of the second end overlay and are in contact, preferably in adhesive contact, with each other. The first and second chemical compositions coact with each other to cause a visually perceptible change in the display region after a predetermined time interval.

U.S. Pat. No. 5,822,280 to Haas describes a time indicator that includes a front layer and a back layer, each having an inner and outer surface. The front layer has a display region on its outer surface. An adhesive means is provided on the inner surface of the front or back layer for adhesively attaching the front layer and back layer to each other. An opaque viewing layer is included on the front or back layer and an activation agent is provided on the other layer. One surface of the opaque viewing layer is viewable from the display region when the front and back layers are adhesively attached to each other. A dye that is substantially non-migrating through the opaque viewing layer, overlies the other surface of the opaque viewing layer. When the inner surfaces of the front and back layers are contacted with each other, the adhesive means adhesively attaches the front and back layers to each other and activates the activation agent. The activation agent migrates to the opaque viewing layer in a predetermined period of time to be absorbed therein. Such absorption activates the dye to enable it to migrate through the opaque viewing layer toward the other side causing an indication in the display region that the predetermined amount of time has expired. Optionally, the activation agent contacts the dye to, for example, solubilize the dye to enable it to migrate through the opaque viewing layer. Preferably, the activating agent is a plasticizer that is absorbed into the polymeric opaque the viewing layer. At a critical concentration of the plasticizer in the viewing layer, the dye is rapidly absorbed into the viewing layer, passing through the viewing layer to the other surface thereof where it becomes visible through the clear display region on, for example, the white background of the viewing layer.

U.S. Pat. No. 5,930,206 to Haas describes a time indicator comprising a front part and a rear part, the rear part comprising an ink pattern layer overlaying a rear support member. The front part comprises a transparent front support layer, and an opaque adhesive layer having a front ink display surface, the adhesive layer capable of dissolving the ink pattern on the rear part, whereby contacting the front part with the rear part by applying the opaque adhesive layer onto the ink pattern layer activates the dissolution and migration of ink in a selected time interval from the ink pattern layer, through the opaque adhesive layer to the front ink display surface for viewing through the transparent front support layer.

U.S. Pat. No. 5,957,458 to Haas et al describes a game card having a hidden game image thereon that is developed over a predetermined period of time. The game card includes a front part and a rear part. The rear part has a migrating ink pattern layer overlaying a rear support member to form a game image. An non-migrating printed pattern layer overlays the rear support member to form a confusion pattern to hide the image. The front part includes a front support layer having an adhesive layer on one side and a front ink display surface on the other side. The adhesive layer is capable of causing the migrating ink pattern to migrate upon contact therewith. Thus when the front part is contacted with the rear part by applying the adhesive layer onto the ink pattern layer, the adhesive layer activates the migration of ink in a selected time interval from the ink pattern layer, through the adhesive layer to the front ink display surface for viewing the game image. Typically, the game image is capable of informing the user whether the game card is a winning card or a losing card.

U.S. Pat. No. 5,974,003 to Pedicano et al. describes a time color indicator that includes a base layer segment having a transparent impermeable layer, a substantially non-curing opaque coating, and a release sheet. A portion of the uncoated surface of the transparent layer bears a printed area including a camouflage pattern printed with non-migrating ink and a message segment printed with migrating ink. An indicator layer segment includes a transparent impermeable layer, a substantially non-curing opaque coating, and a release sheet partially folded back to form a finger gripping tab and expose an indicator layer coating portion which contacts and adheres to the base layer adjacent the printed area. The time color indicator is activated by pulling the finger tab to remove the release sheet, causing the indicator layer coating to cover and contact the printed area, with the message segment migrating through the indicator layer coating.

OBJECTS AND SUMMARY OF THE INVENTION

An object of this invention is to convert commercially available plastic ID cards, usually made of PVC, and/or electronically printed documents, e.g., laser printed documents, photo copier printed documents, dye-sublimation printed documents, ink jet printed documents, into time dependant, self-expiring badges or documents that display a visual indicia, e.g., change of color, appearance of a word, e.g., VOID after a specified or predetermined period of time.

Broadly, a pressure sensitive security sticker is applied to these commercially available plastic ID cards and/or electronically printed documents. The sticker changes color, typically from white to red, after a predetermined period of time. This change in color is caused by the tonr/dye/color pigment contained in these documents. The sticker provides a time dependent indicator for these documents. These security stickers can also display words like 'VOID' after the expiration of the document or card so that security personnel will readily recognize that the ID credential or document is no longer valid.

DETAILED DESCRIPTION OF THE INVENTION

Figure 1:
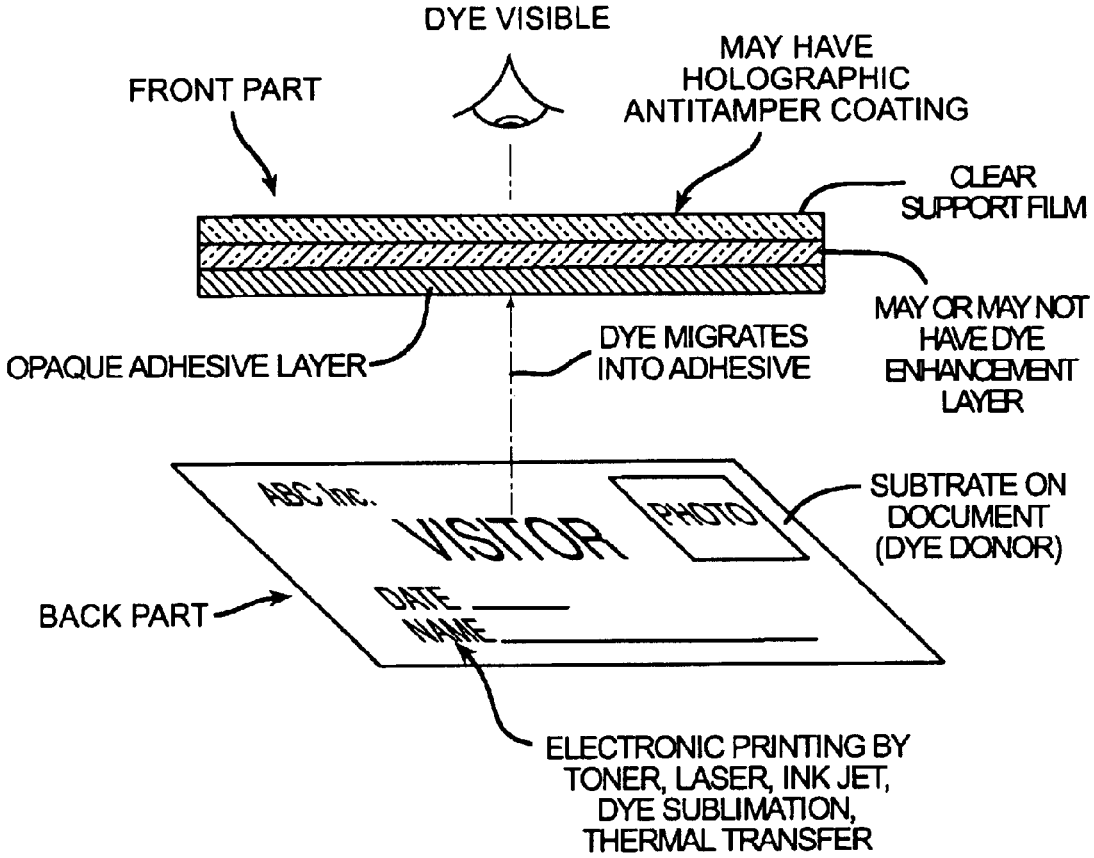
FIG. 1 is a schematic of one embodiment of this invention.
Figure 2:
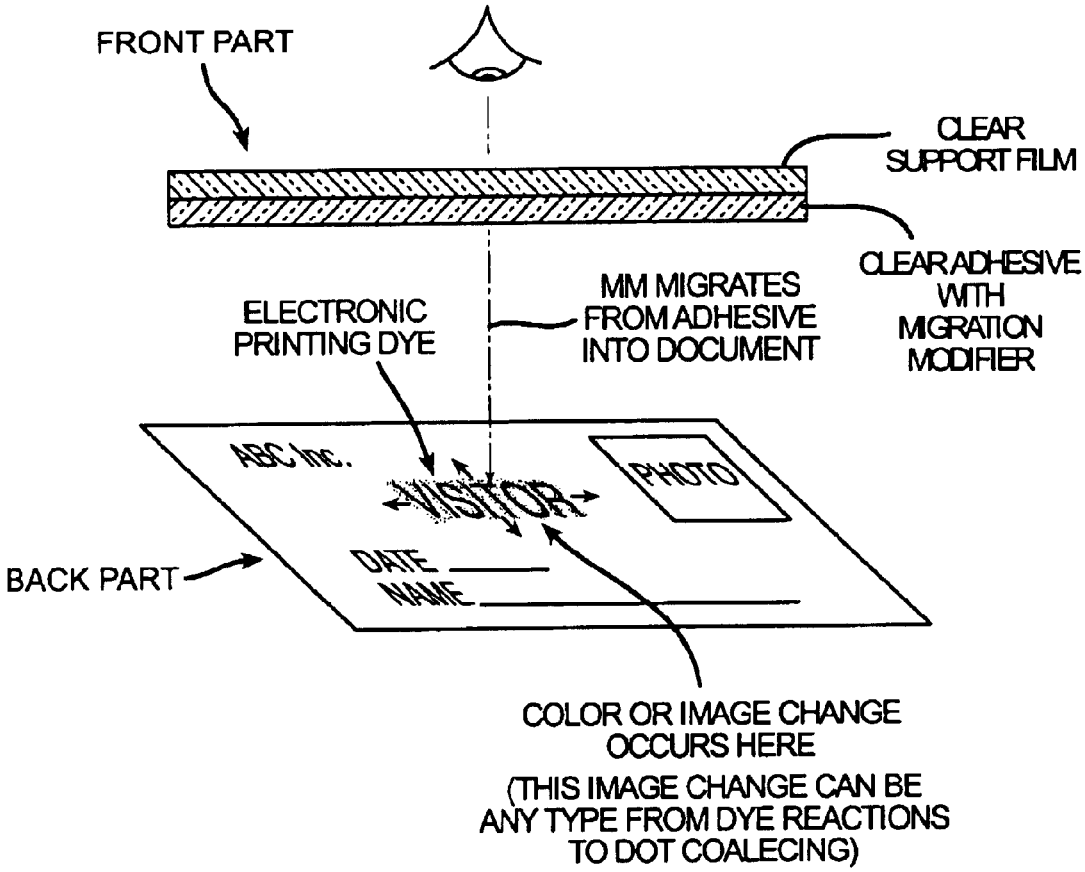
FIG. 2 is a schematic of a second embodiment of this invention.
Figure 3:
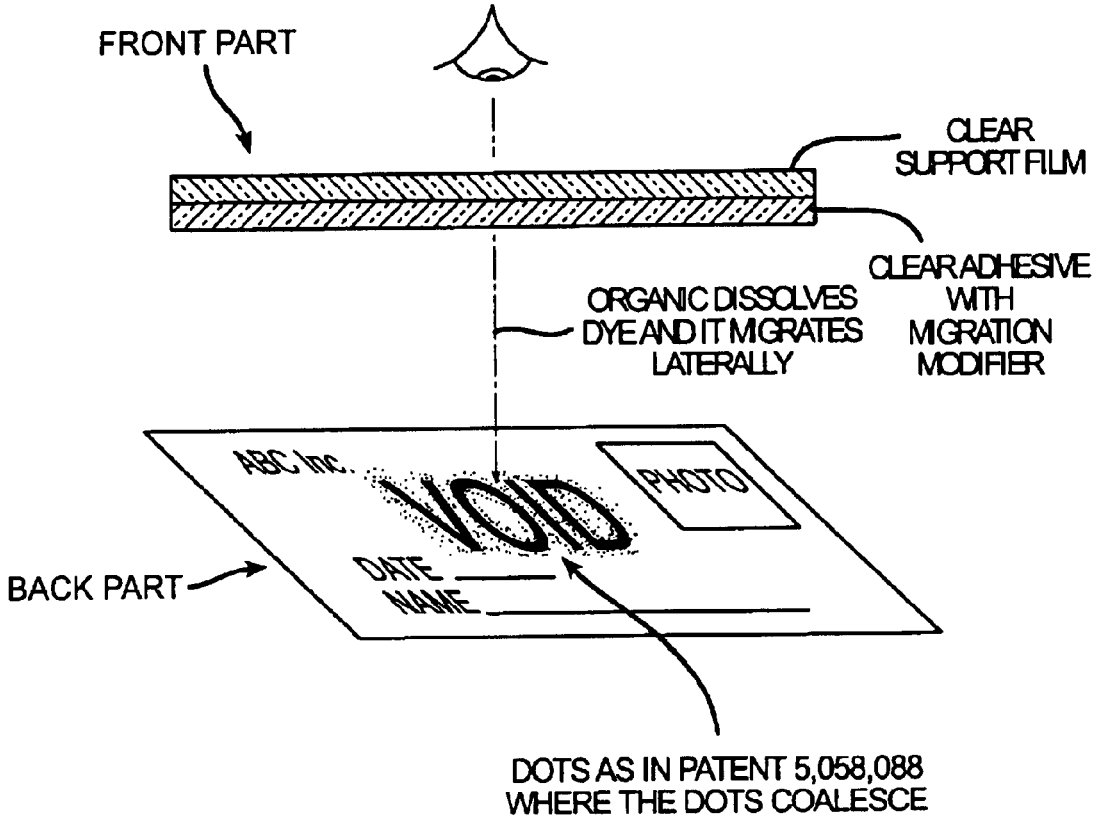
FIG. 3 is a schematic of a third embodiment of this invention.

Since the chemical functionality of the time dependent security sticker is substantially the same for a laser printed document, a photo copier printed document, a dye-sublimation printed document, an ink jet printed documents, independent of the substrate, the invention will be described using a plastic photo ID card as an example. Such ID cards are typically printed by standardized dye sublimation methods.

For ease of reading and understanding, the self-expiring security label of this invention will be called a TIMEsticker. The TIMEsticker of this invention comprises a self-adhesive label (clear or opaque) that can be applied to the face of the PVC photo ID card. Each TIMEsticker is designed with a specific self-expiration time period, e.g., a day, a week, a month, etc. Preferably the TIMEsticker is designed to reveal the word 'VOID' after expiration or reveal another visible indicia of expiration. This can be visible prior to expiration so that the legitimacy of the sticker can be easily determined. After applying the TIMEsticker to the card, and after the time interval associated with the card has passed, a colored dye image on the under surface of the TIMEsticker, the face overlaying the card, bleeds into the TIMEsticker, changing its color and displaying the dye image or pattern, such as the word "VOID" on the front face of the TIMEsticker. This color change is clear and visible to any security officer or employee of the company and enables them to enforce strict control of temporary PVC badges.

The TIMEsticker can be made tamper resistant and tamper-evident. The TIMEsticker may be constructed with a very aggressive adhesive so that it requires substantial force to breach the bond between the card and the TIMEsticker. The TIMEsticker may also be constructed so that when it is peeled off, portions of hidden printing within the TIMEsticker show the words "VOID", thus preventing the TIMEsticker from being reapplied or reused on another PVC card. Such tamper resistant and tamper evident systems are well known when used in conjunction with self-adhesive labels. The TIMEsticker may also include a holographic image, thus making any removal or destruction of the image easily observed by the security personnel.

After a specific pre-designed time interval, dyes from the PVC cards dissolve in certain portions of the TIMEsticker adhesive causing the printing on the PVC card to blur and become lighter while causing the words "VOID" to become visible within the TIMEsticker.

Any number of chemical agents can be used to cause the PVC card to change color. One means is to incorporat a low molecular weight organic in the adhesive so that, upon contact of the adhesive with the PVC card, the organic migrates into the card, dissolves the dye, and causes it to blur and bleed into the adhesive itself.

In another embodiment, a reactive agent such as an acid, base, peroxide, amine, or other active chemical moiety is incorporated into the active adhesive so that it causes the dye to change color, bleach color, or breaks bonds within the plastic to release the dye.

Because the active chemical agent can be contained in an isolated adhesive coating on the TIMEsticker itself, any number of chemical agents can be used to attach the sublimation dyes within the PVC card simply.

Another advantage of this invention is that it is not necessarily dependent on the construction of the PVC card, i.e., it may be used universally on substantially all dye sublimation products.

In another embodiment of this invention, the TIMEsticker can be designed to cause the PVC plastic card to deform by, for example, causing it to swell by absorption of the chemical agent into the surface so that the card becomes thicker and/or warped. This prevents the card from being be reused or "swiped" through a card reader.

The invention is thus directed to a time indicator, particularly adapted for PVC cards, that alerts the security persons that an elapsed time has occurred and validates/invalidates the ID card, by color/image change. Preferably, this invention is used with temporary visitor badges that are printed using a standard PVC ID badge printer in the dye sublimation mode wherein a pressure sensitive overlaminate is placed over the printed image.

The sublimating dye is absorbed into the adhesive and migrate laterally. Alternately, the chemical agent can be absorbed into the card from the TIMEsticker adhesive. Over the specified or predetermined time periods, the image blurs whether the image is in the TIMEsticker or on the face of the card. When the image is unreadable, it is still expired because of the color change. Optionally, the image can be designed to simply change color or disappear altogether.

One embodiment is directed to a "universal" TIMEsticker suitable for use with practically any dye sublimation printed PVC card.

In another embodiment, the invention is designed as a complete system, e.g., a TIMEsticker in combination with a specially constructed PVC ID card. The special card may be fabricated to specific specifications, may consist of a paper stock base and may also contain special migrating dyes within the card.

Optionally, a translucent hologram may be incorporated into the TIMEsticker to validate the authenticity of the card from a distance. The TIMEsticker may also contain tamper evident properties to indicate removal or alteration of the card. A "VOID" pattern can be incorporated into the adhesive. Temperature indicating dyes can be incorporated to indicate that the adhesive has been heated. This technique is commonly used for delaminating pressure sensitive labels.

The TIMEsticker film may also be fabricated of a frangible material that will tear when attempting to remove.

Still further, a second adhesive may be used with the activation adhesive. This can be a very aggressive adhesive used to improve the adhesion properties of the TIMEsticker onto the overlaminate. The two adhesives can be coated in an alternating stripe pattern.

The following are some optional embodiments of the invention and specifications therefore.

Construction — Transparent TIMEsticker (Type I)-Typically one Day, Week, or Month The badge is a plastic PVC-type ID badge that is commonly used in a dye sublimation printer. The Back Part is a plastic card and the Front Part is a clear plastic pressure sensitive laminate.

The Front Part has a clear adhesive cover that is placed on the Back Part to activate the timing. The Front Part is a clear matte acetate, polyester of frangible film. The clear adhesive contains a low molecular weight material (MM—migration modifier) such as a plasticizer or oil suitable to dissolve the dyes and permits the dye to migrate into the adhesive. This MM material plays an important role in the timing mechanism. The film may have an additional layer to show tampering if removed from card or if heated.

The Front Part is zone/pattern coated. A second adhesive is used to adhere to the card such that it is difficult to laminate the Front Part from the plastic card. The activating adhesive may not have the required properties of an aggressive adhesive so a second adhesive will be used to seal the two parts.

The Front Part may also contain a printed image such as "VOID" that is not noticeable before the badge is expired. This image may optionally include the migrating dye wherein the image forms after the bleeding of the dye.

The Front Part may be custom printed, but need not be. Translucent holograms can be hot stamped, embossed or laminated onto the Front Part. Symbols, company logos and other types of information can be printed or incorporated into a hologram. Both offset and flexographic print systems may be used on the substrate depending on customer quantities.

The Back Part contains the migrating dye. Migrating dye may be printed using standard dye sublimation printers.

Preferably, after assembly, the unit is self-destructible, i.e., when the Front Part is pulled away from the Back Part there is an indication of tampering.

Construction —Opaque TlMEsticker (Type II)—Typically One Day, Week, or Month

The TIMEsticker may also incorporate an opaque adhesive so that words on the card, e.g., VOID are displayed on the face of the TIMEsticker after the migration modifier (MM) has dissolved the dyes. In this manner, a white TIMEsticker can be made with color or text. The TIMEsticker may also be used as an authenticity device and be printed with its own text. The dyes from the card can pass into the face of the TIMEsticker and invalidate the authenticity text of the TIMEsticker itself.

Typical specifications for a one week TIMEsticker are as follows:

Environment

Storage=−30 F. to +120 F.

Shelf life

At least 2 years un-assembled.

Operating Temperature

The indicator will be typically be used in a climate-controlled environment. The temperature usually is between 70 to 80 F. (75±15 F.).

Transition Window (Time to change from completely white when assembled to a readable red image)

7-Day Indicator—when used on a dye-sublimation PVC card with a printed 0 layer protective coating Using our test specification, (75 F. for 24 hours), the 12 point times roman font will be unreadable between 120 to 200 hours. Other images such as facial photos will be blurry.

7-Day Indicator —PVC/polyester composite card

Using our test specification, (75 F for 24 hours), the 12 point times roman font will be unreadable between 120 to 200 hours. Other images such as facial photos will be blurry.

Other Specifications

Material must be die cuttable, and processable.

The Front Part must be able to accept printing.

Non-hazardous materials must be used.

Assembly is performed by the end-user and must be intuitive.

Tamper evident is required.

Size

Less than 2" by 3" and allowing for slot in the card.

Prefer a unique shape but can be rectangle or oval.

Adhesive properties of Laminate Front Part 30 min 180 degree peel (1 mil dry cast adhesive on polyester and stainless steel test panel (PSTC-1 30 minute dwell)

Packaging

The units will be complete and packaged 500 units per pack. Standard packing. Or as required by customer.

It will be understood that various changes in the details, arrangements and configuration of the parts and assemblies which have been described and illustrated may be made by those skilled in the art within the principle and scope of the present invention.

Thus there are several objects of this invention:

An opaque pressure sensitive label is applied to a substrate with electronic printed data or images thereon, which after application to the substrate, produces a visible color change after a specified time interval within the pressure sensitive label itself or on the surface of or within the substrate itself.

The pressure sensitive label may incorporate tamper indicating devices such as holograms, frangible materials, optical variable layers, etc.

The pressure sensitive label may contain organic migrating modifiers which, after contact to an electronic printed substrate, migrate into the dyes and substrate to change the dye color.

The pressure sensitive label may contain organic migrating modifiers which, after contact to an electronic printed substrate, cause the dyes to migrate into the pressure sensitive adhesive.

The pressure sensitive label which contains organic migrating modifiers which, after contact with an electronic printed substrate, migrate into the substrate causing printed dot patterns of dye to coalesce to form visible images or words.

The pressure sensitive label which contains organic migrating modifiers which, after contact with an electronic printed substrate, cannot be removed from the substrate without visible evidence of removal.

The pressure sensitive label which contains organic migrating modifiers which, after contact to an electronic printed substrate, causes the migrating modifiers to dissolve the protective coating or barrier on the face of the substrate before dissolving the electronic printed dyes.

What is claimed is:

1. A method of producing a time dependent security badge comprising:

electronically printing an identification badge to provide electronic print on one surface thereof;

providing a plastic laminate comprising a selected adhesive on one surface, the adhesive selected to dissolve and blur the electronic print on the surface after a predetermined period of time;

applying the one surface having the adhesive thereon to the surface of the badge having the print thereon to activate the badge, wherein the print bleeds and blurs after the period of time to provide a void indicia that is seen through the plastic laminate.

2. The method of claim 1, wherein the plastic laminate is clear.

3. The method of claim 1, wherein the electronically printing step is dye sublimation printing.

4. The method of claim 3, wherein the identification badge is PVC.

5. The method of claim 3, wherein the plastic laminate is clear.

6. The method of claim 1, wherein the electronically printing step is laser printing.

7. The method of claim 1, wherein the electronically printing step is photocopier printing.

8. The method of claim 1, wherein the electronically printing step is jet printing.

9. The method of claim 1, wherein the electronically printing step is done at the time of issuance of the security badge.

* * * * *